US006034339A

United States Patent [19]

Pinholt et al.

[11] Patent Number: 6,034,339

[45] Date of Patent: Mar. 7, 2000

[54] ELECTROSTATICALLY CONTROLLED MICROSWITCH

[75] Inventors: Peter Pinholt, Boinp; Ole Hansen, Hørsholm, both of Denmark

[73] Assignee: LD A/S, Ballerup, Denmark

[21] Appl. No.: 08/973,413

[22] PCT Filed: Jun. 3, 1996

[86] PCT No.: PCT/DK96/00234

§ 371 Date: Apr. 20, 1998

§ 102(e) Date: Apr. 20, 1998

[87] PCT Pub. No.: WO96/38850

PCT Pub. Date: Dec. 5, 1996

[30] Foreign Application Priority Data

Jun. 2, 1995 [NO] Norway ..... 952190

[51] Int. Cl.[7] ..... H01H 57/00; H01H 35/00

[52] U.S. Cl. ..... 200/181; 307/112; 200/83 N

[58] Field of Search ..... 200/83 N, 181; 361/206, 207; 310/310, 317; 29/DIG. 95; 257/415–418; 307/112, 116

[56] References Cited

U.S. PATENT DOCUMENTS

| | | | |
|---|---|---|---|
| 2,927,255 | 3/1960 | Diesel | 361/207 |
| 2,931,954 | 4/1960 | Diesel | 200/181 X |
| 3,009,032 | 11/1961 | Friend et al. | 200/83 N |
| 3,268,683 | 8/1966 | Palmer | 200/83 N |
| 3,571,542 | 3/1971 | Madden et al. | 200/83 N |
| 4,000,386 | 12/1976 | Brouwer | 200/83 N X |
| 4,395,651 | 7/1983 | Yamamoto | 310/317 |
| 5,479,042 | 12/1995 | James et al. | 200/181 X |

FOREIGN PATENT DOCUMENTS

| | | |
|---|---|---|
| 4119955 | 12/1992 | Germany . |
| 4205029 | 2/1993 | Germany . |
| 3228211 | 8/1993 | Germany . |
| 4205340 | 8/1993 | Germany . |
| 4305033 | 10/1993 | Germany . |
| 4058428 | 2/1992 | Japan . |
| 4058429 | 2/1992 | Japan . |
| 462228 | 6/1975 | U.S.S.R. . |
| 1363323 | 12/1987 | U.S.S.R. . |
| 2095911 | 10/1982 | United Kingdom . |
| 9418688 | 8/1994 | WIPO . |

OTHER PUBLICATIONS

Petersen, K.E., "Micromechanical Membrane Switches On Silicon," *IBM Journal Of Research And Development*, vol. 23 No. 4, Jul. 1979, pp. 376–385.

Derwent Abstract of SU 1363 323 of Dec. 1987.

Gretillat, M.A., et al. "Electrostatic Polysilicon Microrelays Integrated with MOSFETs" IEEE(1994) pp 97–101.

Hackett, R.H.. et al. "Alternative Materials For Micro–Elecro–Mechanical Device Construction", Materials Research Society, vol. 276 (1992) pp 241–252.

English Abstract of SU 462228 dated Jun. 23, 1975.

English Abstract of JP 4058429 dated Feb. 25, 1992.

English Abstract of JP 4058428 dated Feb. 25, 1992.

*Primary Examiner*—J. R. Scott
*Attorney, Agent, or Firm*—Ladas & Parry

[57] ABSTRACT

A switch has a housing defining a closed cavity having opposite, first and second walls. A first control electrode is on the first wall. A first contact electrode is on one of the first and second walls. A diaphragm electrode is across the cavity and spaced from the first contact electrode, the diaphragm electrode being responsive to electric potential relative to the first control electrode for flexing across the space and into contact with the first contact electrode, whereby to close the switch.

17 Claims, 6 Drawing Sheets

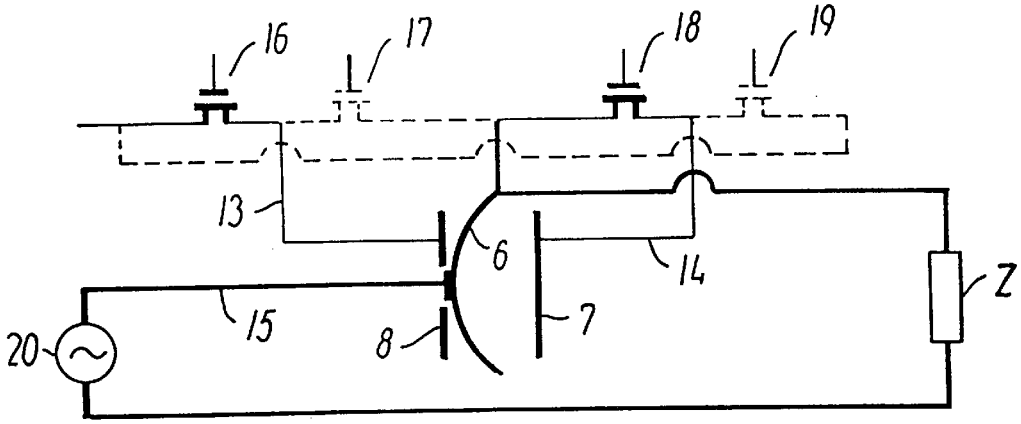
FIG. 2
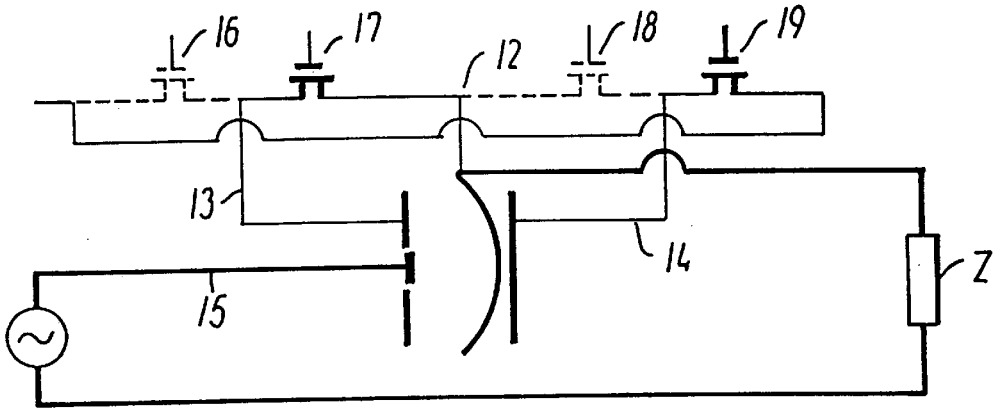
FIG. 3
FIG. 4
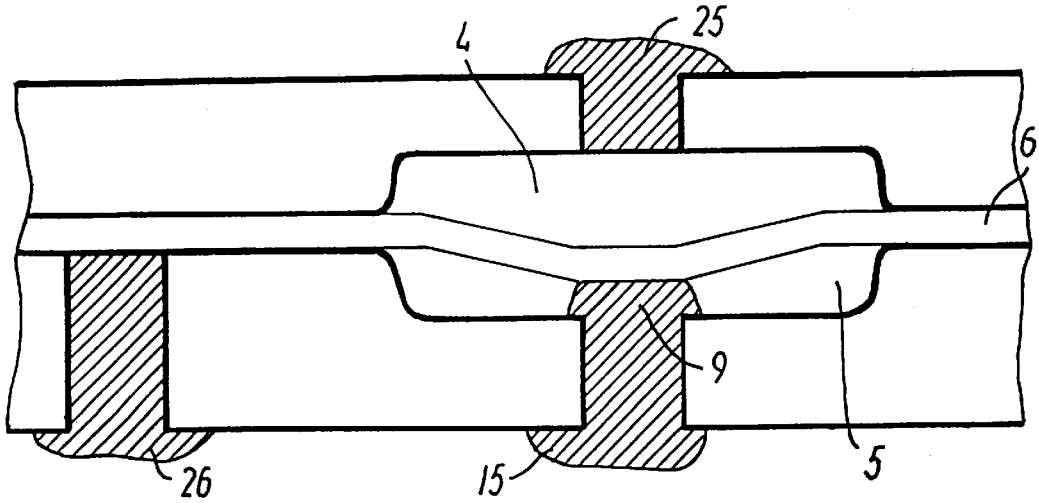

ELECTROSTATICALLY CONTROLLED MICROSWITCH

BACKGROUND OF THE INVENTION

The invention concerns a controllable microswitch comprising a closed cavity having a plurality of contact electrodes, a movable switch body capable of making and breaking an electrical connection between the contact electrodes, and a plurality of control electrodes capable of generating an electrical field to control the position of the switch body. The invention moreover concerns methods of making such a microswitch. Finally, the invention concerns use of a microswitch for power regulation of systems connected to an electrical power source and for remote-controlled connection and disconnection of an apparatus in an electrical mains supply.

A need is being created for an "intelligent" installation system where the user can turn on and off selected electrical appliances at specific times all around the clock via a central computer or via central logic. The user will obtain greater convenience and flexibility, and the supplier of electricity can obtain a better control of the load in the mains supply—particularly during peak load periods—through direct control or through differentiated electricity prices.

The mains voltage to the consumer is up to 230 V, and in traditional contact breakers it is therefore necessary to maintain an insulation distance of about 2 mm between the live parts internally in the contact breaker owing to arc formation. This electrode distance may be calculated by means of Paschen's law.

Micromechanical relays are known and are described e.g. by Grétillat et al. in an article in "Proceedings of the 1994IEEE Micro Electro Mechanical System", January–February 1994, p. 97–101, by Hackett et al. in the article "Smart Materials Fabrication and Materials for Micro-Electro-Mechanical Systems" edited by Jardine et al. and in "Materials Research Society Symposium Proceedings", vol. 276, Apr. 28–30, 1992, p. 241–252. These relays are designed to connect and disconnect small currents and voltages, the use being low power electronics, i.e. currents in the range around 1 mA and voltages in the range around 10 V.

GB-A-2 095 911 defines an electrical switch having a tiltable switch body, where the position of the switch body is controlled by means of an applied electrical field. The switch cavity of the switch may be under vacuum or filled with an inactive gas, thereby preventing the control voltage from causing flashover.

JP-A-4-58428 and JP-A-58429 disclose an electrostatic relay produced by semiconductor technology. The relay has an evacuated switch housing with a tiltable switch body, e.g. of palladium.

DE-C-42 05 029 discloses a micromechanical relay which operates by means of electrostatic control. The switch housing of the relay accommodates an armature through which the contact electrodes may be connected with each other. The armature is formed by a resilient arm on which a conducting web has been applied.

DE-A-43 05 033 and DE-C-42 05 340 both disclose a relay structure in which armature arms are replaced by an armature plate on which the conducting web has been applied. The armature plate is suspended resiliently by means of connecting bridges at the corners of the plate.

However, in these switches having a switch body arranged in a closed cavity, it is a problem that the contacts provided on the switch body have a relatively small area and can therefore just connect low voltages and currents like the above-mentioned micromechanical relays. Further, mechanical wear may occur owing to the movement of the switch body at the points where it is connected to the fixed part of the switch.

SU-A-462 228 discloses another type of electrostatic relay where the switch body is not arranged in a closed cavity. Instead, a contact is arranged on a diaphragm-like member which is fixed between two end pieces. As no closed cavity is involved, this relay does not allow the contacts to be placed under vacuum or in an inactive gas, which is absolutely necessary if small dimensions are to be combined with high voltages. Further, this relay, too, has small contact areas and thus relatively great contact resistances, so that just small currents can be connected. Finally, the connection to the actual contact in this relay takes place by means of a tape connector, which cannot be used with small dimensions and closed cavities.

SUMMARY OF THE INVENTION

The object of the invention is to provide a controllable switch of the type described in the opening paragraph, which has a switch body capable of breaking and closing voltages and currents of the order that occur in an electrical mains supply, said switch body having a simple geometry and being subjected only to modest wear because of its movement.

This object is achieved in that the switch body is formed by a diaphragm which is provided with a conducting surface and which divides the cavity into two subcavities. Such a structure allows the conducting surface of the diaphragm to be formed with a large contact area, which enables cutting-in of greater currents. Further, the activation area may be made large, so that an electrostatic activation principle may be utilized in the switch.

What is decisive for the invention is thus the large area of the diaphragm which may serve as a contact electrode and as a control or activation electrode, respectively. A large contact area in combination with the ability of the contact faces to be pressed together with a sufficiently great force because of a large activation area makes it possible to produce a contact which has a sufficiently small contact resistance and can thus break and close great powers.

The actual switch may advantageously be manufactured by means of semiconductor technology, and therefore, in terms of production, it will be extremely advantageous to use a flexible diaphragm, since this may merely be placed on the semiconductor substrate when the switch housing parts are formed.

The controllable switch may advantageously be formed with a switch cavity whose height is small with respect to the two other dimensions of the cavity. The cavity will hereby have two opposed walls which face each other, which are thus essentially parallel with the diaphragm. The diaphragm will hereby be able to create electrical contact with one or more protruding contact electrodes at one wall of the cavity by small, electrostatically controlled movements. Two contact electrodes at the same wall may hereby be interconnected or short-circuited via a conducting part of the diaphragm.

The movement of the diaphragm may be optimized in that it is secured along the circumference of the cavity.

The electrostatic control of the diaphragm may be achieved in that both walls of the cavity are formed as control electrodes, and one of these cooperates with the diaphragm to provide the necessary force. The control voltage may advantageously be the supply voltage, which is to be controlled, superposed by a DC voltage of a suitable size and polarity. It has been found to be expedient to use a DC voltage corresponding to the peak value of the supply voltage when the supply voltage is an AC voltage.

In another embodiment, the electrostatic control is achieved in that the diaphragm is used as a control electrode, while one of the walls of the cavity is formed as a second control electrode. Here, the phase voltage may be used for establishing the necessary force between the two control electrodes.

The actual diaphragm may moreover form one of the contact electrodes, said diaphragm being connected through its deflection to a contact electrode protruding from one cavity wall. Another embodiment may comprise protruding contact electrodes from both cavity walls, enabling the contact electrode on the diaphragm, under the control of the diaphragm deflection, to be brought into contact with one of the contact electrodes in the two walls or to assume the contact-free central position. This embodiment may be used e.g. for deciding whether a plug is to provided with 110 V, 230 V or be disconnected.

Although the diaphragm in the switch housing may be insulating with an applied, conducting surface, the diaphragm itself may advantageously be made conductive, e.g. as a sheet web placed between the parts of the switch housing. This sheet web may advantageously be metallic, and e.g. aluminium presents a good mechanical strength and good current-carrying properties.

When working with microswitches to be capable of being implemented in plugs (outlets from public mains supply), it is important that the risk of voltage flashover is minimized to the greatest extent possible, while making the electrode distances as small as possible. This is done in a preferred embodiment of the invention in that the switch cavity is hermetically closed and either evacuated with a view to creating vacuum or filled with inactive gas, where e.g. helium may be used. The electrode distances may hereby be made small, without involving any risk of flashover.

When the electrostatic activation principle is combined with evacuation of the switch cavity or filling thereof with an inactive gas, the switch of the invention may be made extremely small. It can thus be incorporated as a controllable switch in ordinary plugs. The microswitch may thus be placed decentrally.

The diaphragm may be formed hermetically tight so that it separates the two subcavities which are thus not connected with each other. In that case, the diaphragm may be pressure biased with respect to the protruding contact electrode in that the gas pressure on the two sides of the diaphragm is different.

Alternatively, the diaphragm may be perforated so that the pressure in the two subcavites is the same.

In an expedient embodiment, the cavity is shaped so that the two walls are substantially circular. In that case, also the control electrodes may advantageously be circular.

Such a switch may be made by a method of the invention by forming depressions in the two substrate surfaces, and assembling the substrate surfaces formed with depressions around a diaphragm sheet, which divides the switch cavity formed with the depressions. Further, the method comprises providing at least one additional activation electrode, which cooperates with a conducting face on the diaphragm, and at least one additional contact electrode which may be connected with a part serving as a contact electrode on the diaphragm.

In a preferred embodiment, the switch may be integrated in a chip together with the necessary control circuit. It may be used for power regulation of systems connected with an electrical voltage source and hereby replace semiconductor based switches, such as thyristors or power transistors in e.g. dimmers, motor controls and power converters, as the switch of the invention will have a smaller power consumption because of the small contact resistance and the electrostatic principle, while it is capable of working very rapidly since the diaphragm in vacuum meets no air resistance. A switching time of 10 $\mu$s can be achieved at any rate.

Another field of use of the controllable switch is as a circuit breaker for remote-controlled connection and disconnection of an apparatus in an electrical mains supply.

The switch may also be used in combination with a local, user-operated contact breaker in a mains outlet. The mains outlet, which is operated locally, may hereby be overruled centrally. The central control will frequently take place via a central computer located in the house-hold concerned. It is the electrostatic activation principle combined with vacuum or inactive gas in the switch cavity which allows miniaturization of the switch so that it may be incorporated in existing contacts.

BRIEF DESCRIPTION OF THE DRAWING

The invention will be explained more fully below in connection with preferred embodiments and with reference to the drawing, in which:

FIGS. 2 and 3 illustrate how the control may be performed in the preferred embodiment of the microswitch shown in FIG. 1;

FIG. 4 schematically shows an alternative embodiment of a controllable microswitch of the invention;

DESCRIPTION OF PREFERRED EMBODIMENTS

Figure 1:
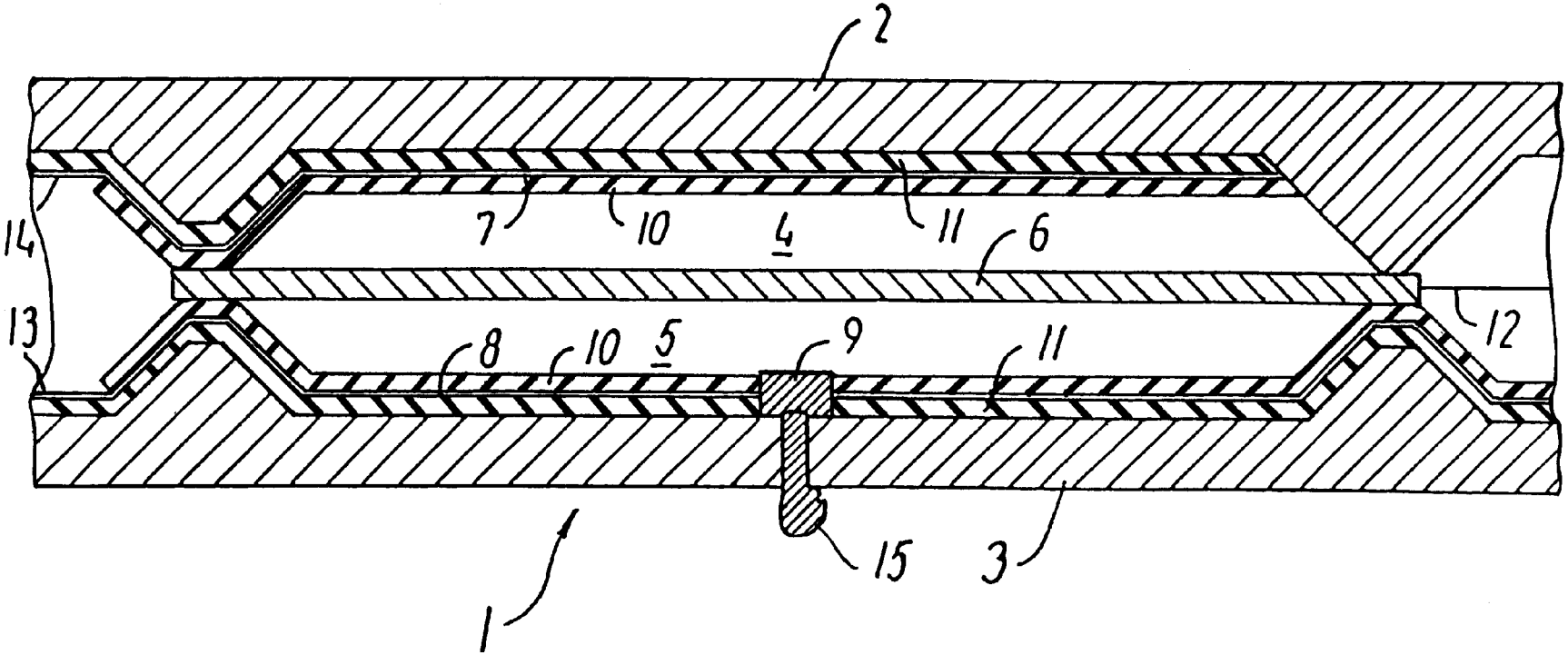
FIG. 1 schematically shows a preferred embodiment of a controllable microswitch of the invention.

FIG. 1 shows a preferred embodiment of a microswitch of the invention, and it will be seen from the figure that, in the shown embodiment, the microswitch serves as a contact breaker, it being capable of closing or breaking the current between two contact electrodes.

The contact breaker shown in FIG. 1 has a contact breaker or switch housing 1 provided between two substrate walls 2 and 3, e.g. of silicon. The housing 1 includes a cavity which is divided into two compartments 4 and 5 by a flexible, conducting diaphragm sheet. The diaphragm sheet or the diaphragm 6 may be of aluminium, copper or other suitable materials which present suitable properties mechanically and electrically by themselves or by a composite structure.

The diaphragm is shown to be stretched, but usually it will be flexible in practice, so that it is the electrical or pressure bias that keeps it in the desired position. It should be noted here that the drawing is out of scale to facilitate the understanding, as the ratio of switch cavity diameter to switch cavity height will usually be greater than shown by the drawing.

The two compartments 4 and 5 are assembled at a very low pressure, thereby permitting a very small electrode distance in the open state—right down to the range around 10 $\mu$m. According to the invention, the diaphragm 6, which here constitutes the movable part of the contact breaker, is moved by an electrostatic, capacitive activator, which here comprises two activation electrodes 7 and 8 in the form of two conducting faces, e.g. of metal, or formed as semiconducting layers, said layers being essentially parallel with the diaphragm 6. These conducting surfaces are applied to the substrate, but are electrically insulated from the substrate by means of silicon oxide layers 11 and covered by insulating layers 10. When a voltage difference is applied between the diaphragm 6 and one of the electrodes 7 or 8, the diaphragm 6 will be deflected from its position of equilibrium.

The switch cavity itself may advantageously be circular, which reduces the stress at the diaphragm edges as much as possible. Further, the electrical field between the activation electrodes will be more or less uniform. The two activation electrodes 7 and 8 may thus be approximately circular, it being noted that the activation electrode 8 has a central hole through which a contact electrode 9 protrudes. A suitable voltage difference between diaphragm and one activation electrode provides contact between the diaphragm 6 and the contact electrode 9. The contact is hereby made.

If the contact is to be broken, the activation voltage is applied between the diaphragm 6 and the other activation electrode.

It is noted that contact with one contact electrode 9 has been made through a bore in a substrate wall 3 filled with a conducting material 15. The two activation electrodes 7 and 8 are contacted (not shown) e.g. in an adjacent area of the cavity via parts 13 and 14. The diaphragm 6 may be contacted in the same manner via a protruding part 12.

In addition to the circular shape of the switch cavity, a plurality of other shapes may be used. Examples include a square or otherwise polygonal switch cavity.

The contact shown in FIG. 1 is a so-called normally open contact, as it will be open (the current will be interrupted), if there is no voltage on the activation electrodes.

The control principle is shown in FIGS. 2 and 3. In case of a contact breaker to be used in a consumer outlet (phase voltage of 230 V), an activation voltage of e.g. 300 V may easily be provided by serially connecting a diode and a capacitor as a current pump. This voltage may subsequently be raised to the potential of the phase voltage.

The activation voltage is applied to the electrodes via two sets of transistors, which then conduct as shown in solid line in FIGS. 2 and 3, which show the contact breaker in the closed state and the broken state, respectively. In the closed state of the contact breaker, the transistors 16 and 18 conduct, while the transistors 17 and 19 conduct in the broken state. A phase from the mains supply indicated by the current source 20 is connected to a load Z via the contact breaker when the contact breaker is closed.

FIG. 4 shows an alternative embodiment of the switch of the invention, illustrating a contact breaker having a biased diaphragm. It is a normally closed contact breaker. One of the cavity compartments 4 is filled with an inactive gas at a pressure of about 20 kPa (the atmospheric pressure is about 101 kPa), while the other compartment is under vacuum (0.1 kPa).

The activation electrode on the switch cavity wall is made accessible for electrical contact via a conductor 25 formed in a passage drilled through the substrate wall. Corresponding conductors 15 and 26 are formed for the contact electrode 9 arranged in the wall and for the diaphragm 6, which serves as a common contact and activation electrode. This results in a large contact area.

Figure 5:
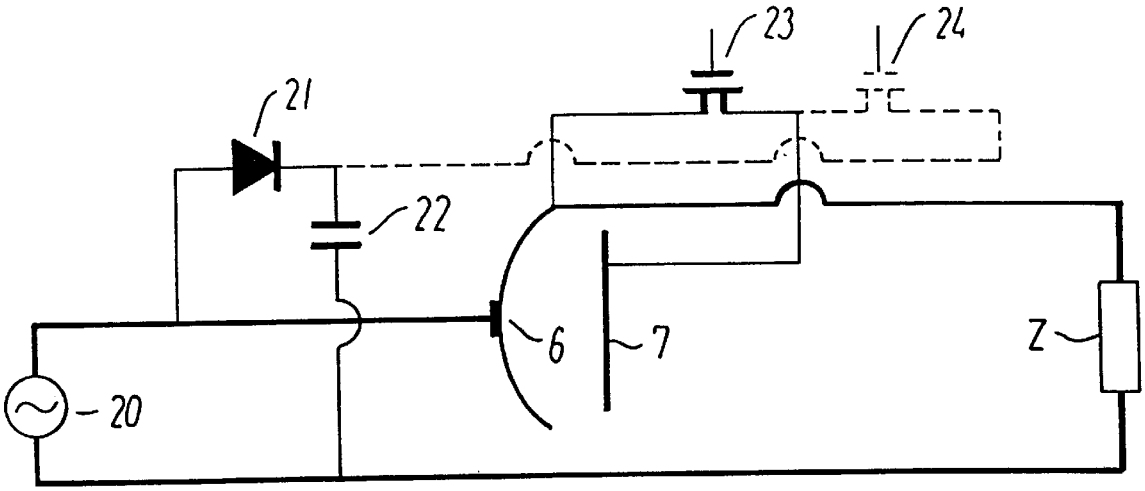
FIGS. 5 and 6 illustrate how the control may be performed in the preferred embodiment of the microswitch shown in FIG. 4.
Figure 6:
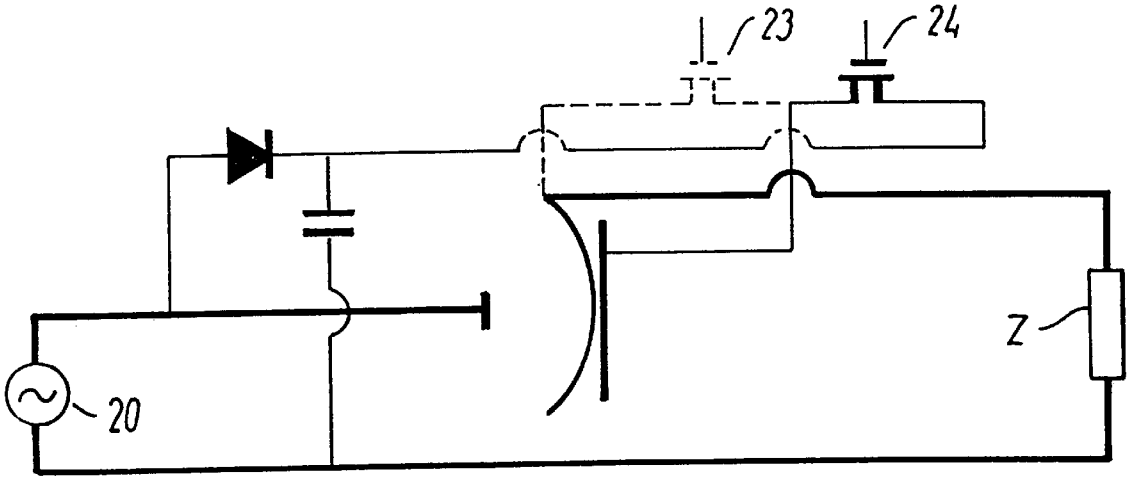

The control principle is shown in FIGS. 5 and 6, from which it will be seen that the current pump comprises a diode 21 and a capacitor 22 which together supply the necessary activation voltage. It will be seen that, here, there is just one activation electrode 7 which cooperates with the diaphragm 6.

Figure 7:
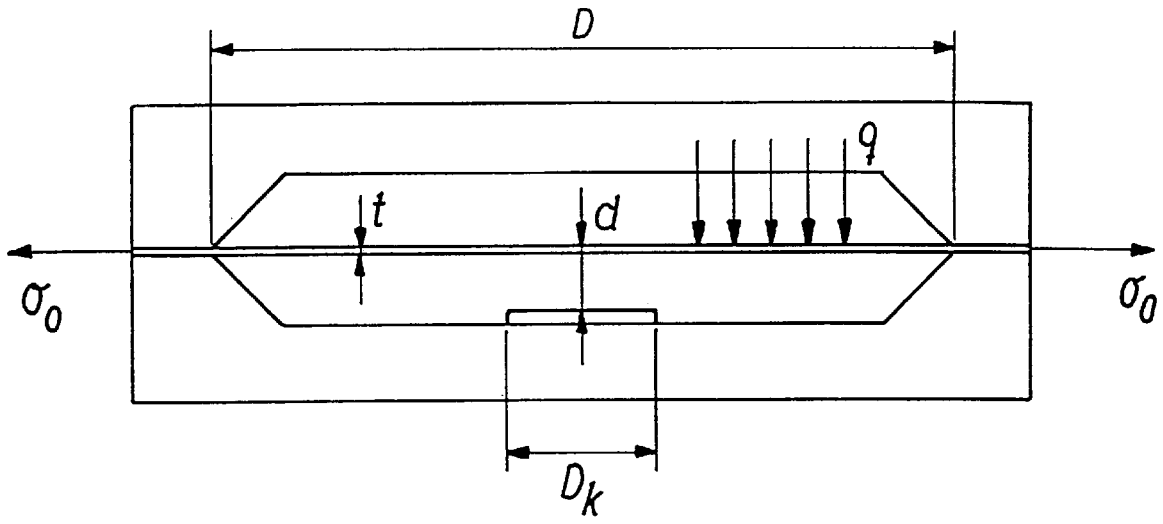
FIG. 7 illustrates how a microswitch may be dimensioned according to the invention.

FIG. 7 shows a switch of the invention. D represents the diaphragm diameter, t the diaphragm thickness, and d is the distance between diaphragm and contact electrode. The electrostatically activated diaphragm is deflected by application of an electrical voltage, where the necessary voltage $\phi$ to ensure a deflection d for the switch shown in FIG. 7 is given by:

$$\phi = \sqrt{\frac{32}{3\epsilon_0}\frac{t^3}{\left(\frac{D}{2}\right)^4(1-\upsilon^2)}\left[E + \frac{3\left(\frac{D}{2}\right)^2(1-\upsilon^2)}{4t^2}\sigma_0\right]d^3},$$

$\sigma_o$ is the net stress along the rim of the diaphragm, where the sum of the modulus of elasticity E and the term in the above formula in which $\sigma_o$ is included, may be considered as the effective modulus of elasticity. $\nu$ is Poisson's ratio for the diaphragm material.

In a preferred embodiment, the diaphragm has a diameter D of 10 mm, and the diaphragm is made as an aluminium sheet ($\nu$(Al)=0.345, $\rho$(Al)≡2.7 g/cm$^3$ and E(Al)=70 GN/m$^2$ at 0.2% plastic deformation). Each of the two silicon substrates constitutes a half-shell. The diaphragm has a thickness of 10 $\mu$m, and the distance between the diaphragm and the contact point is likewise 10 $\mu$m. If the diaphragm is secured without tension, the stress along the rim may be neglected, so that the activation voltage $\phi$ will be about 12 V. The above-mentioned activation voltage of 300 V is thus great enough to deflect the diaphragm.

If the diameter of the contact electrode is 1 mm, the activator distance is 4 mm, the activation voltage is 300 V, and the net load is e.g. 10 A, the power loss in the shown example may be determined to be below 0.1 W. The activation mechanism is thus capable of providing the low contact resistance which is required for contact breakers in the mains supply.

Figure 8:
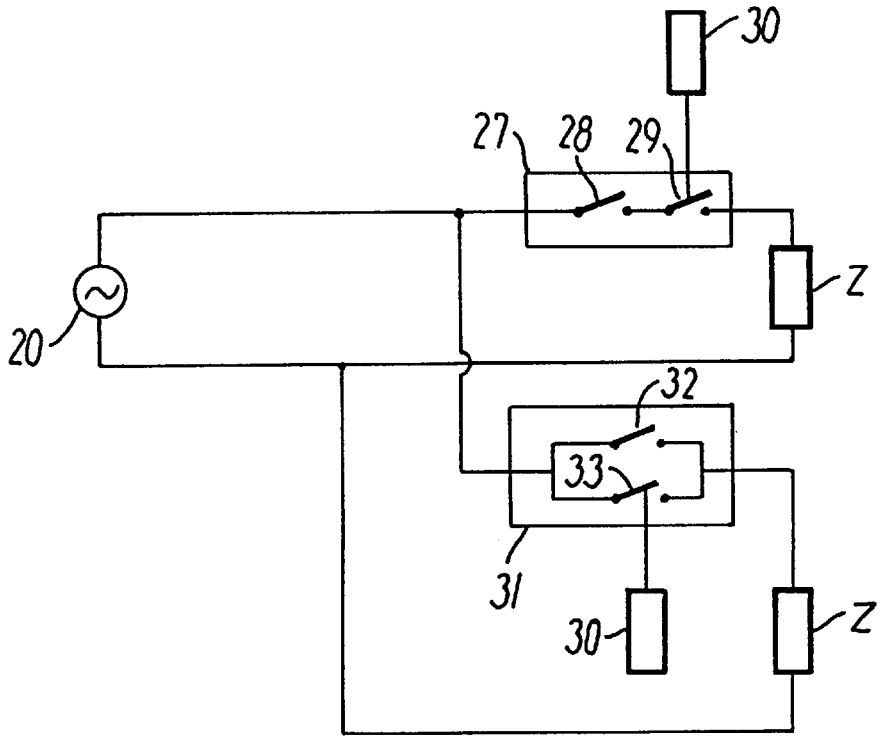
FIG. 8 shows how the microswitch of the invention may be implemented in a consumer outlet in a mains supply.

FIG. 8 shows contact arrangements 27 and 31 according to the invention. These contact arrangements 27 and 31 connect respective loads Z with a mains supply 20. It is shown in principle in the figure how a controllable contact breaker or switch is arranged in a contact arrangement in the form of a plug or a mains outlet, and a skilled person will therefore easily be able to implement the invention in already existing contact arrangements.

The contact arrangement 27 has two serially connected on/off contact breakers 28 and 29, said contact breaker 28 being manually operated by the user, said contact breaker 29 being controlled by a central control unit. The contact breaker 29 overrules the contact breaker 28, as the contact breaker 28 can only switch on and off when the contact breaker 29 is closed. It is possible centrally to interrupt the connection to the load through the contact arrangement 27.

Correspondingly, it is possible centrally to assure the connection to the load via a controlled switch 33, which is connected in parallel to a manually operated contact breaker 32 in contact arrangements 31.

A manufacturing process for a contact, e.g. an NO contact in which the base electrode serves as a current conductor, is shown in FIGS. 9*a–g*. The process sequences for the two individual parts are specified in table 9.1 and table 9.2, while assembly and packing of the component appears from table 9.3.

The first step in the procedure of making part 1 of the contact involves oxidation of silicon followed by LPCVD (Low Pressure Chemical Vapour Deposition) of silicon nitride ($Si_3N_4$). A first mask layer is reproduced in the $Si_3N_4$ layer by RIE (reactive ion etch) in a mixture of $SF_6$ and $O_2$ with photoresist as a mask, which is subsequently removed in an oxygen plasma. A second mask layer is applied to the disc, and, with photoresist as a mask, patterns are etched by RIE in the oxide layer with a mixture of $CF_4$ and $CHF_3$. This is followed by a photoresist strip (in oxygen).

Step 7 is an etch of bulk silicon in a mixture of potassium hydroxide (KOH), isopropyl alcohol (IPA) and water. This etch forms the central contact. Step 8 strips the oxide mask from the contact island, and then the cavity is formed in step 9 by a KOH+IPA etch. Step 10 removes the $Si_3N_4$ mask, which is followed by RCA cleaning (to remove alkali metal residues). The result of these process steps can be seen in FIG. 9*b*).

The oxidation mask is formed in steps 12–16 by oxidation of LPCVD $Si_3N_4$, mask step 3.1 and RIE. Then a ~3 $\mu$m silicon dioxide layer is formed by wet oxidation.

Step 17 comprises deposition by LPCVD phosphor doped polysilicon. An activator electrode is formed therein in steps 18–19. A 3 $\mu$m PYREX glass layer is formed by electron beam vapour deposition followed by an LPCVD undoped polysilicon. Steps 23–25 expose the central contact, and then contact metallization is performed by lift-off in steps 26–28. This completes the process ring for part 1. The result of this process can be seen in FIG. 9*f*).

Figure 9:
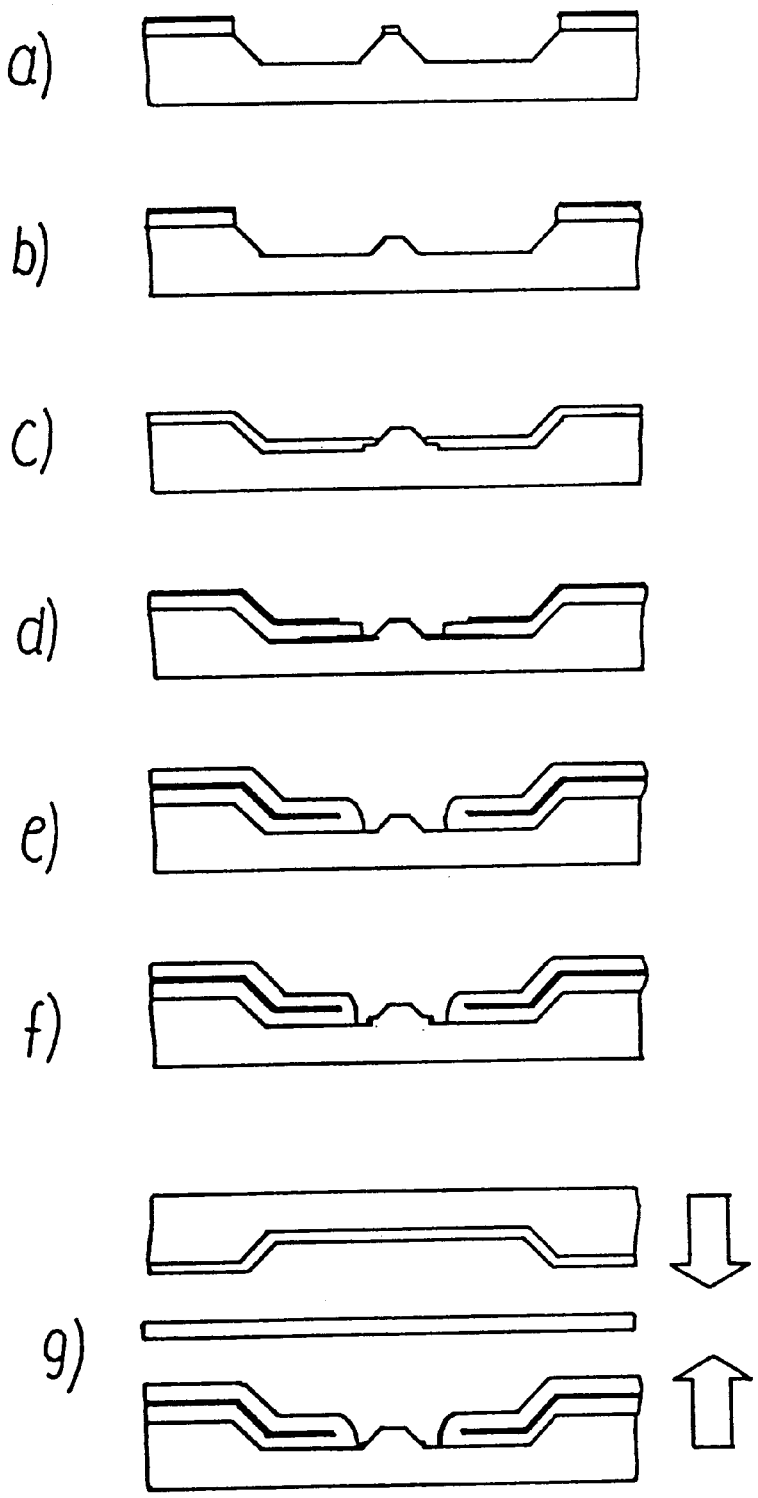
FIGS. 9 and 10 show how a switch of the invention may be manufactured by means of well-known processes from the semiconductor industry.

The production of the second half of the contact shown in FIG. 9.2 makes use of the same processes as in the production of the first half. The result of this process is shown as the upper part of FIG. 9*g*).

The two separate halves of the contact are bonded together in a two-step process by electrostatic bonding. In this process, aluminium is electrostatically bonded to PYREX glass. The wafer is subsequently cut into chips, and superfluous aluminium diaphragm is removed. The diaphragm is mounted in a housing with electrically conducting glue and bonded with gold wires. The contact with associated bonding is shown in FIG. 1. Finally, the top packing is mounted and the component is ready for use. If an operation temperature of the component does not exceed 100° C., the metal packing may be replaced by a cheaper moulded plastics seal.

The process sequences of the halves of the contact include no processes which have not already been demonstrated in connection with silicon micromechanics.

TABLE 9.1

| | |
|---|---|
| 1) | Oxidation of silicon (4000 Å) |
| 2) | LPCVD $Si_3N_4$ (1500 Å) |
| 3) | Photoresist process with mask layer 1.1 |
| 4.1) | RIE of $Si_3N_4$ ($SF_6$ + $O_2$) |
| 4.2) | RIE of photoresist ($O_2$) |
| 5) | Photoresist process with mask layer 2.1 |
| 6.1) | RIE of $SiO_2$ ($CF_4$ + $CHF_3$) |
| 6.2) | RIE of photoresist ($O_2$) |
| 7) | Etch in KOH + IPA (e.g. 100 Å/min) |

TABLE 9.1-continued

| | |
|---|---|
| 8) | Etch of oxide in BHF |
| 9) | Etch in KOH + IPA |
| 10) | Strip of $Si_3N_4$ in (e.g. 180° C.) $H_3PO_4$ |
| 11) | RCA I + II (cleaning) |
| 12) | Oxidation of silicon (1500 Å) |
| 13) | LPCVD $Si_3N_4$ (1500 Å) |
| 14) | Photoresist process with mask layer 3.1 |
| 15.1) | RIE of $Si_3N_4$ ($SF_6$ + $O_2$) |
| 15.2) | RIE of photoresist ($O_2$) |
| 16) | Oxidation of silicon (~3 $\mu$m) |
| 17) | LPCVD phosphor doped polysilicon (~8000 Å) |
| 18) | Photoresist process with mask layer 4.1 |
| 19.1) | RIE of polysi ($SF_6$ + $O_2$) |
| 19.2) | RIE of photoresist ($O_2$) |
| 20) | E-beam PYREX glass depositing (~ 3 $\mu$m) |
| 21) | LPCVD polysilicon (~ 1 $\mu$m) |
| 22) | Photoresist process with mask layer 5.1 |
| 23) | RIE of polysi ($SF_6$ + $O_2$) |
| 24) | BHF of PYREX glass |
| 25.1) | RIE of doped polysi |
| 25.2) | RIE of optional photoresists ($O_2$) |
| 26) | Thick photoresist process with mask layer 6.1 |
| 27) | Vapour depositing of contact metallization (e.g. Ti + Pt) |
| 28) | Lift-off |

Table 9.1: Process sequence of the first half of a micro-mechanical contact of the invention produced in silicon substrate.

TABLE 9.2

| | |
|---|---|
| 1) | Oxidation of silicon (4000 Å) |
| 2) | LPCVD $Si_3N_4$ (1500 Å) |
| 3) | Photoresist process with mask layer 1.2 |
| 4.1) | RIE of $Si_3N_4$ ($SF_6$ + $O_2$) |
| 4.2) | RIE of photoresist ($O_2$) |
| 5) | Etch in KOH + IPA (e.g. 100 Å/min) |
| 6) | Strip of $Si_3N_4$ in 180° C. $H_3PO_4$ |
| 7) | RCA cleaning |
| 8) | Dry oxidation of silicon (1500 Å) |
| 9) | LPCVD $Si_3N_4$ (1500 Å) |
| 14) | Photoresist process with mask layer 2.2 |
| 15.1) | RIE of $Si_3N_4$ ($SF_6$ + $O_2$) |
| 15.2) | RIE of photoresist ($O_2$) |
| 16) | Etch in KOH (e.g. 1.3 $\mu$m/min) |
| 17) | RCA cleaning |
| 18) | E-beam PYREX glass deposition (~3 $\mu$m) |

Table 9.2: Process sequence for the second half of the micromechanical contact.

TABLE 9.3

| | |
|---|---|
| 1) | Electrostatic bonding of part 1 (PYREX glass) to the aluminium diaphragm |
| 2) | Electrostatic bonding of part 2 (PYREX glass) to part 1 (aluminium) |
| 3) | Cutting of chip with saw |
| 4) | Etching away of superfluous aluminium diaphragm with wax masking |
| 5) | Plasma stripping of wax |
| 6) | Mounting of the component in metal housing with electrically conducting glue |
| 7) | Ultrasonic bonding of gold wires to the contact |
| 8) | Welding of cover on metal packing |
| | *** |

Table 9.3: Assembling and bonding of the micromechanical contact.

As silicon exhibits relatively modest electrical conductivity, the current should only be carried through it over short distances, or—even better—exclusively be carried in metal.

To replace silicon as the substrate material, the required alternative must exhibit the same planarity and possibility of providing an electrically insulating oxide having a high breakdown voltage. Glass ($SiO_2$) having metallic lead-in as well as aluminium/aluminium oxide may be used for this purpose.

An alternative manufacturing process will be described below. The process for glass will be a combination of the process for silicon (to deposit activation electrodes) and the process for aluminium to mount aluminium sheet on the substrate.

Figure 10:
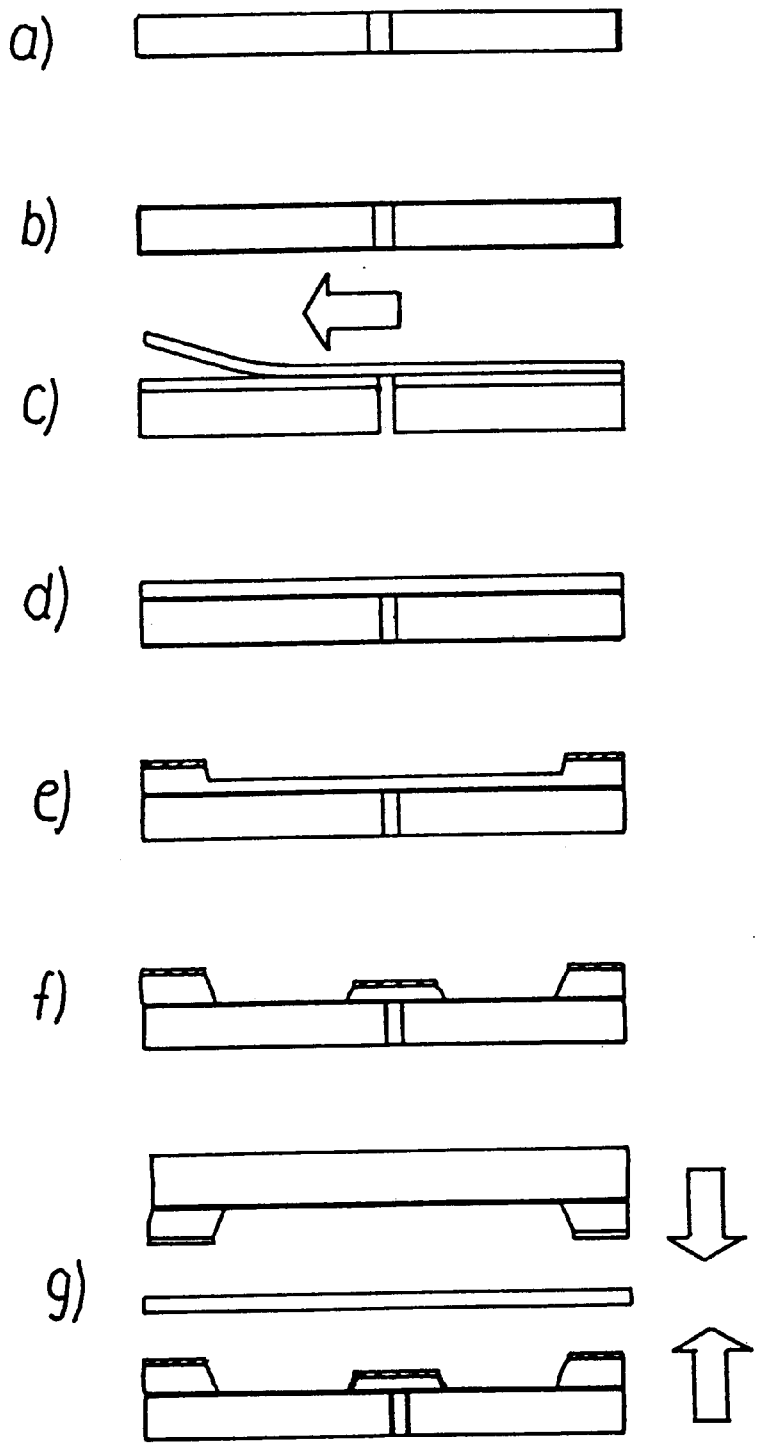

The manufacturing process for a NO contact is shown in FIGS. 10*a*)-*g*). The process sequence for the first half is specified in table 10.1, while the process sequence for the second half and the assembling of the component are described in table 10.2.

Steps 1–4 of the manufacturing process for the first half involves drilling of holes in the aluminium substrate and subsequent cleaning and anodizing (anodic oxidation). Drilling of holes may be performed by traditional mechanical drilling or by an electrochemical process. The latter process should be preferred, since mechanical drilling will leave dust which impairs the possibility of bonding the three parts together.

Steps 5–6 comprise mounting a metal sheet over the drilled holes to ensure a hermetically sealed lead-in. A plate base is applied to the hole by metal vapour deposition of chromium/gold through proximity mask. The front contacts for the component are defined hereby. This is followed in step 10 by metal plating (Cu). Hermetical electrical lead-ins are hereby created, as shown in FIG. 10*d*).

Steps 11–17 of the process comprise formation of the central contact and the diaphragm cavity by etch in $H_3PO_4$ masked with a combination of photoresist and gold. This gold will subsequently serve as a binder in a eutectic bond to aluminium.

The processes for manufacturing the other half of the contact are shown in table 10.2. Here, the same set of processes is used as in the production of the first half 1. The result of this process is shown as the upper part of FIG. 10*g*).

The two separate parts of the contact are bonded together in a two-step process by eutectic bonding. First, metal sheet is bonded to the contact part 2, and then part 1 is bonded to the sheet. The eutectic bonds will then be made in a low pressure atmosphere with a substrate temperature of 340° C. After completed bonding, the components are cut with a saw and mounted in a housing with electrically conducting glue. Gold wires are bonded to the component and the top packing is mounted, following which the component is ready for use.

TABLE 10.1

| | |
|---|---|
| 1) | Holes are marked on the aluminium substrate |
| 2) | Holes are drilled (with mechanical drill or electrochemically) |
| 3) | The substrate is cleaned |
| 4) | The aluminium substrate is anodized |
| 5) | Chromium/gold is vapour-deposited (Cr/Au at 50 Å/3000 Å) |
| 6) | Bonding of aluminium sheet to the substrate by Au/Al eutectic (340° C.) |
| 7) | Rear contacts are defined by proximity masking |
| 8) | Chromium/gold layers are vapour-deposited in holes |
| 9) | Lift-off of chromium/gold layer to define rear contact |
| 10) | Copper plating for metal lead-in and rear contact |
| 11) | Bonding areas are defined by proximity mask (front) |
| 12) | Chromium/gold layer is vapour-deposited on the aluminium sheet (front) |
| 13) | Lift-off of chromium/gold layer |

TABLE 10.1-continued

| | |
|---|---|
| 14) | Contact area is defined with proximity mask (front) |
| 15) | Phosphoric acid etch ($H_3PO_4$) of aluminium to provide 1 $\mu$m contact |
| 16) | Strip of photoresist in acetone |
| 17) | The sheet is etched through (~11 $\mu$m) |

Table 10.1 Alternative for the first half of a microme-chanical contact according to another embodiment of the invention produced in aluminium substrate.

TABLE 10:2

| | |
|---|---|
| 1) | The substrate is cleaned and anodized |
| 2) | Mask layer 2.1 is defined |
| 3) | Chromium/gold layer is vapour-deposited (Cr/Au 50 Å/3000 Å) |
| 4) | Lift-off |
| 5) | Etch of aluminium oxide in BHF |
| 6) | Vacuum bonding of aluminium diaphragm to the substrate by Au/Al eutectic (340° C.) |
| 7) | Vacuum bonding of part 1 to the aluminium sheet on part 2 |
| 8) | Cutting of chip with saw |
| 9) | Mounting of the component in metal housing with electrically conducting glue |
| 10) | Ultrasonic bonding of gold wires to the contact |
| 11) | Welding of cover to metal packing |

Table 10:2 Process sequence for producing the second half and bonding of the micromechanical contact.

Construction of the movable part as a diaphragm provides the greatest possible activation area between activation electrode and the movable part. This increases the contact force and reduces the contact resistance to a level allowing the contact to be implemented in the consumer outlet. When the diaphragm is then used as activation electrode, current path and contact point, the area is utilized fully.

We claim:

1. A switch, comprising:

a housing defining a cavity;

a contact electrode;

a control electrode;

diaphragm means having a conducting surface across the cavity for movement in response to electric potential relative to the control electrode into electrical contact with the contact electrode, whereby to close the switch.

2. A switch, comprising:

a housing defining a closed cavity having opposite, first and second walls;

a first control electrode on the first wall;

a first contact electrode on one of the first and second walls; and a diaphragm electrode across the cavity and spaced from the first contact electrode, the diaphragm electrode being responsive to electric potential relative to the first control electrode for flexing across the space and into contact with the first contact electrode, whereby to close the switch.

3. A switch according to claim 2, wherein the walls and diaphragm electrode are parallel and a distance between the walls is substantially smaller than a dimension across the cavity in the plane of the diaphragm electrode.

4. The switch according to claim 3, wherein the diaphragm electrode is secured to the housing about a circumference of the cavity.

5. The switch according to claim 3, and further comprising a second control electrode on the second wall.

6. The switch according to claim 2, wherein the diaphragm electrode consists of a conductive material.

7. The switch according to claim 1, wherein the diaphragm means is a metal sheet.

8. The switch according to claim 2, wherein the cavity is under vacuum.

9. The switch according to claim 8, wherein the cavity contains an inactive gas.

10. The switch according to claim 2, wherein the diaphragm electrode separates the cavity into two subcavities that are not connected with each other.

11. The switch according to claim 10, wherein gas pressures in the subcavities are unequal.

12. The switch according to claim 2, wherein the diaphragm electrode is perforated for maintaining equal gas pressures on opposite sides of the diaphragm electrode.

13. The switch according to claim 2, wherein the walls are substantially circular.

14. A method, comprising:

operating the switch according to claim 1, for power regulation of a system connected to an electrical voltage source.

15. The method according to claim 14, wherein the system is a modulator in a dimmer, motor control, or power converter.

16. A method, comprising:

operating the switch according to claim 1, for remote-controlled connection and disconnection of an electrical apparatus.

17. A method, comprising:

providing a local, user-operated contact breaker to connect and disconnect an apparatus in an electrical mains supply; and enabling a switch according to claim 1 to determine by central control whether the user-operated contact breaker can connect or disconnect the apparatus.

* * * * *

UNITED STATES PATENT AND TRADEMARK OFFICE

CERTIFICATE OF CORRECTION

PATENT NO. : 6,034,339

DATED : March 7, 2000

INVENTOR(S) : Peter PINHOLT, et al.

It is certified that error appears in the above-identified patent and that said Letters Patent is hereby corrected as shown below:

On title page, item 73, "LD" should be -- LK --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*